US005388747A

United States Patent [19]

Chen

[11] Patent Number: 5,388,747

[45] Date of Patent: Feb. 14, 1995

[54] POSITIVE YARN FEEDING DEVICE

[76] Inventor: Jen-Hui Chen, 4FL., No. 27, Lane 160, Hsin Sheng S. Rd., Sec. 1, Taipei, Taiwan, Prov. of China

[21] Appl. No.: 72,301

[22] Filed: Jun. 3, 1993

[51] Int. Cl.[6] ..... B65H 59/18

[52] U.S. Cl. ..... 226/174; 226/66; 66/132 R

[58] Field of Search ..... 226/66, 174; 66/132 R, 66/133; 242/47.01

[56] References Cited

U.S. PATENT DOCUMENTS 4,673,139 6/1987 Memminger et al. ..... 242/47.01
4,706,476 11/1987 Memminger et al. ..... 242/47.01 X
4,986,316 1/1991 Morohashi et al. ..... 242/47.01 X

*Primary Examiner*—Andrew M. Falik
*Attorney, Agent, or Firm*—Pro-Techtor International

[57] ABSTRACT

An positive yarn feeding device including a support body mounted on a beam member, a multilayer yarn feeding wheel having frictional yarn feeding periphery, multiple drive pulleys, multiple tension controllers each having a movable yarn guiding arm, and a yarn braking assembly. The yarn feeding wheel and the drive pulleys are rotatably concentrically secured in a bearing of the support body and a clutch is disposed between the pulleys for optionally adjusting the operating speed of the roller. Each movable yarn guiding arm is disposed with a yarn guiding eyelet through which a yarn passes. The movable yarn guiding arm is pivotally supported between a first position where the yarn guiding eyelet is away from the frictional periphery of the yarn feeding wheel, and a second position where the yarn guiding eyelet is adjacent to the frictional periphery thereof. The yarn braking assembly is disposed on a yarn outgoing side of the yarn feeding wheel for keeping the yarn tensioned and avoiding twisting of adjacent yarns. The movable yarn guiding arms and the yarn braking assembly are exchangeably respectively disposed on two sides of the yarn feeding wheel.

6 Claims, 9 Drawing Sheets

POSITIVE YARN FEEDING DEVICE

BACKGROUND OF THE INVENTION

The present invention relates to an positive yarn feeding device, and more particularly to an positive yarn feeding device in which the operation speed can be optionally adjusted and the yarns with different colors can be easily interchanged.

An positive yarn feeding device is developed for knitting colorful cloth from various colors of yarns. The early positive yarn feeding device employs electromagnetically controlled measures in the yarn feeding operation. For example, Taiwan Invention Patent Application No. 7113777 discloses a yarn feeding device for optionally feeding several yarns to a horizontal yarn knitting machine. In such device multiple sensors 7A–7D, D1/T1, D2/T2, D3/T3, D4/T4, etc. for detecting the position of the yarn guiding arms, and multiple relays CR, timers TC, TD1, TD2 and quite complicated logic control circuit are necessary to form the device.. Therefore, the cost thereof is very high and cannot be accepted in the market. Moreover in the site of the knitting machine, the fluffs always suspend in the air and attach to the device so that the logic circuit cannot work stably. Above all, once the contacts of the relays' circuit and timer are jammed with fluffs, the work thereof will fail and the whole control circuit will malfunction.

Taiwan Utility Model Patent Application No. 7223942 discloses a positive yarn feeding device for a knitting machine which improves the above technical problem, in which when the knitting machine needs yarns in knitting operation, the tension of the yarn is increased and when the tension is greater than a preset value of the yarn feeding device, the yarn on the yarn feeding roller is pulled by a movable yarn guiding arm to contact with the frictional yarn feeding surface of the yarn feeding wheel so as to achieve the object of positive yarn feeding. Such structure is simple and practical. However, recently the knitting market tends to develop the knitting technique of multiple colors and twin yarn feeders so as to achieve various colors and figures of the product. When it is desired to produce two colors or three colors of alternately knitted cloth, two or three layers of yarn feeding wheels are necessary to be vertically piled for meeting the factory technical requirement. As shown in FIG. 9, the movable yarn guide 45 and the tension control means are disposed right under the yarn feeding wheels 17, 18 and the drive pully 16. Accordingly, when two colors or four colors of yarns are fed under the same yarn feeding wheel at the same time for knitting a cloth with colorful stripes, two or over two layers of yarn feeding wheels will be needed. This greatly increases the height of the space for the operation and causes difficulty in yarn threading and connecting processes. Moreover, when controlling or adjusting the speed, such height is always far beyond the head of an operator and thus causes great inconvenience. In addition, multiple yarns are parallelly disposed and tend to interfere with one another. In case there are three or more than three layers of yarn feeding wheels, the errors in operation will take place even more frequently. Above all, when the feeding speed of the yarn feeding wheels on the same layer cannot meet the knitting requirement and the yarn needs to be guided to the more upward or more downward layer of yarn feeding wheel, the yarn must be first torn off and then the yarn connecting and threading processes can be performed. Accordingly, the knitting changing operation will be quite time-costing and labor-costing. Besides, in such a yarn feeding operation, the main yarn feeding technique is such that whether the yarn feeding operation should be performed is decided by the effect of the frictional outer periphery of the yarn feeding wheel and the necessary tension of the yarn. However, when the yarn feeding wheel does not feed the yarn, as shown in FIG. 10, the yarn 76 still contacts with the frictional periphery of the yarn feeding wheel by at least 90 degree contacting angle. If the frictional coefficient of the yarn feeding wheel is too great, mistakes in operation will take place. The mistake which occurs most often is that when the yarn is not needed and the contacting angle between the yarn 76 and the frictional periphery of the yarn feeding wheel is considerably large, the yarn will be still fed to cause negative yarn feeding phenomenon. Therefore, the space between the stripes of the knitted cloth will be irregular or the stripes will be oblique. While the fixed yarn guiding arm 25 is adjustable as shown in FIG. 11 to minimize the contacting angle between the yarn 76 and the periphery of the yarn feeding wheel 17 or maximize the contacting angle to be over 180 degrees when positively feeding the yarn, because the yarn guiding arm 25 of the yarn feeding wheel is disposed above the yarn feeding wheel, when the number of the yarn feeding wheel is over 120, it is very difficult or even impossible to adjust the yarn feeding wheels one by one. In addition, in two color or three color knitting operation, it will be quite difficult to operate or adjust the second or third layer wheel since the height thereof will be unreachable. Therefore, the fixed arm 25 in fact is unable to meet the requirement of the present knitting market.

Moreover, if the yarn feeding wheels have the same operation speed for multicolor knitting operation, although the wheels can be disposed on the same level, the space between the wheels will be too small to operate the yarn. This will affect the time for changing the knitting operation and the amount of the products or even indirectly cause failure of the device. If the currently most popular elastic rubber yarn or metal yarn is to be mixed with the general yarns, because the space is limited, such mixing process cannot be accomplished. Therefore, the pattern of the produced cloth will not satisfy the present market requirement. In case each yarn feeding wheel feeds two yarns at the same time barely, since the yarn guiding eye thereof has only one single eyelet, although the tension of the yarn can separate the adjacent two yarns when the yarns are fed, once the yarn feeding operation is stopped and the tension of the yarn disappears, the adjacent two or three yarns will twist with one another due to the self-twisting property thereof. Therefore, when the device is again activated, the failure thereof will inevitably occur. Therefore, the yarn feeding wheel can feed only one single yarn.

SUMMARY OF THE INVENTION

It is therefore a primary object of the present invention to provide an positive yarn feeding device in which a multilayer yarn feeding wheel and drive pulleys are rotatably concentrically secured in bearings of a support body and a clutch is disposed between each two pulleys for optionally adjusting operation speed. Multiple tension control means each having a movable arch-shaped yarn guiding arm are disposed on one side of the yarn feeding wheel to effectively control the tension of the yarn. According to the present invention, not only the height of the multilayer yarn feeding wheel is appropriate but also the space between each two adjacent layers of yarn feeding wheels is enlarged. Moreover, when adjusting the yarn feeding operation speed for one color of yarn, it is no more necessary to replace and thread the yarn. Therefore, it is convenient to thread and carry the yarn and perform the speed and color changing processes.

It is a further object of the present invention to provide the above yarn feeding device, wherein a yarn braking means assembly is further disposed on a yarn outgoing side of the yarn feeding wheel for keeping the yarn tensioned and avoiding twisting of the yarns with one another due to external force.

It is still a further object of the present invention to provide the above yarn feeding device, wherein the yarn is freely guided by the movable yarn guiding arm, whereby under a non yarn feeding state, the yarn is completely free from contact with the outer periphery of the yarn feeding wheel so that the negative feeding of the yarn is eliminated.

It is still a further object of the present invention to provide the above yarn feeding device, wherein the space between the respective yarn feeding wheel is wider and each layer of the multilayer yarn feeding wheel can feed two yarns at the same time. Also, the elastic rubber yarn or metal yarn can be mixed with the general yarns in the knitting process.

It is still a further object of the present invention to provide the above yarn feeding device in which the movable yarn guiding arm may have two yarn guiding eyelets at a free end thereof and the yarn braking means are disposed on the yarn outgoing side of the yarn feeding wheel for controlling the tension of the yarn so that when the yarn is not fed, the yarns remain orderly.

The present invention can be best understood through the following description and accompanying drawings, wherein:

DETAILED DESCRIPTION OF THE PREFERRED EMBODIMENTS

Figure 1:
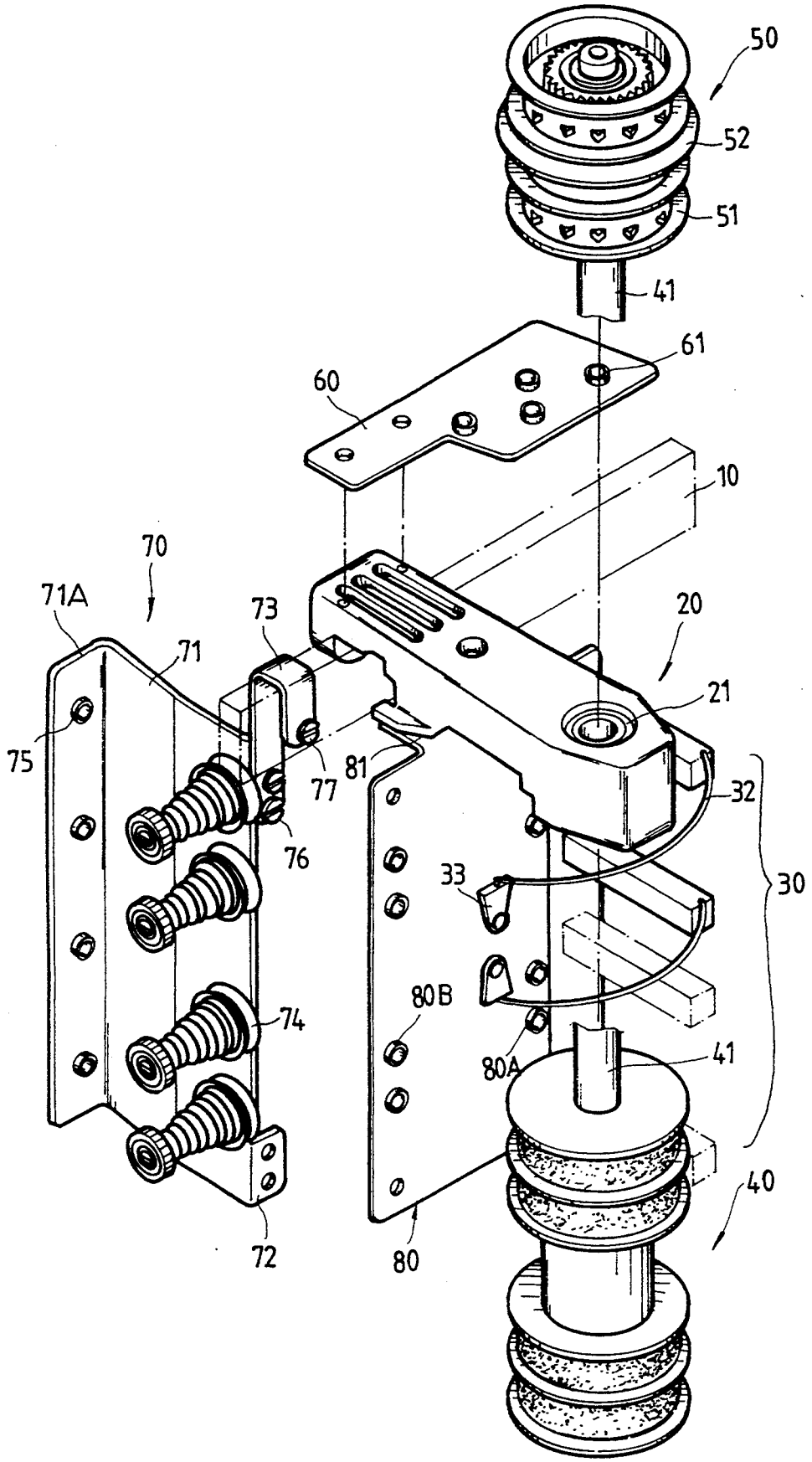
FIG. 1 is a perspective exploded view of the present invention.

For simplifying the description, the same or corresponding elements of respective embodiments of the present invention are denoted by the same reference numerals.

Figure 2:
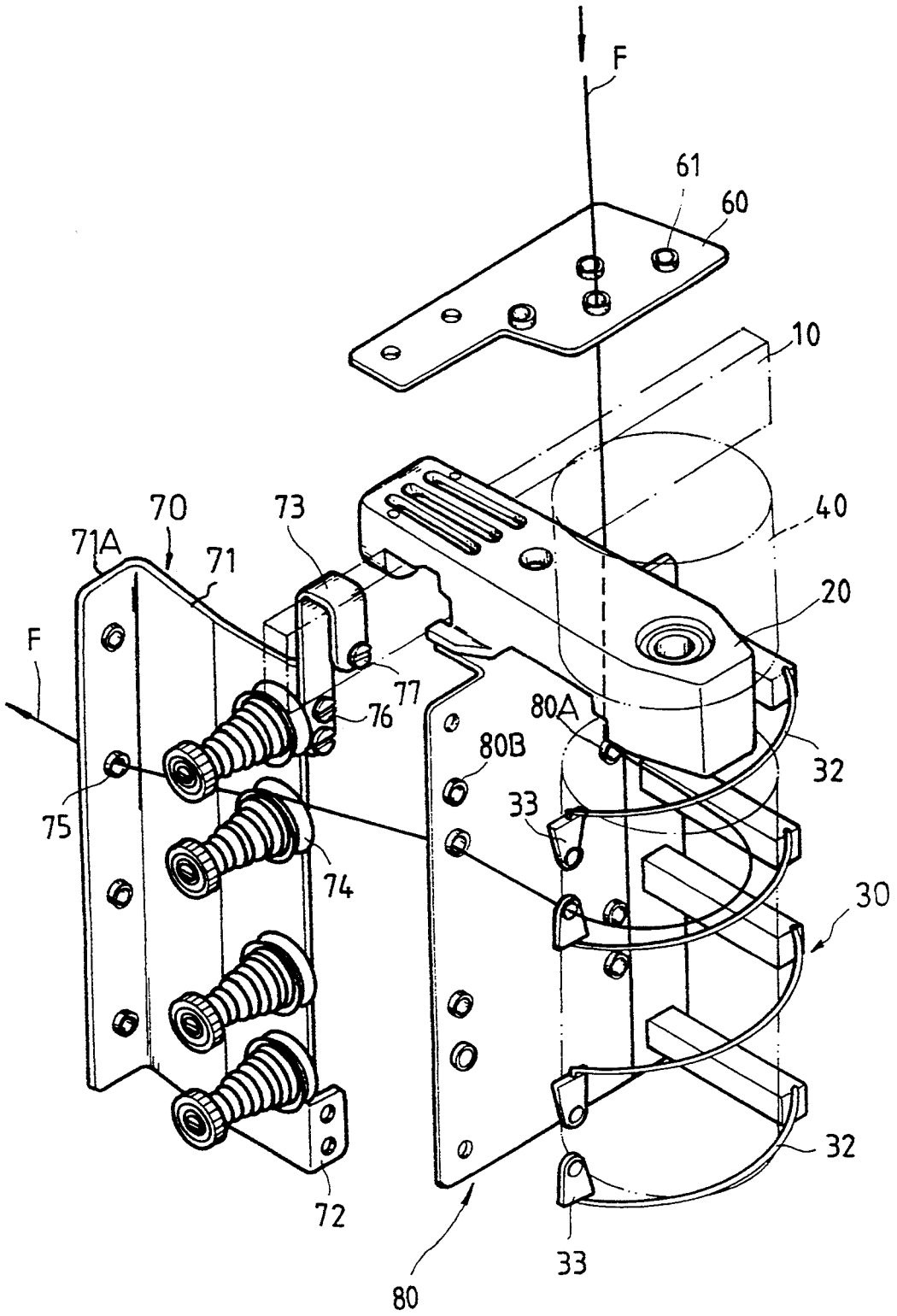
FIG. 2 is a view according to FIG. 1, wherein the yarn feeding roller is omitted and the yarn path is sketched by solid lines.
Figure 3:
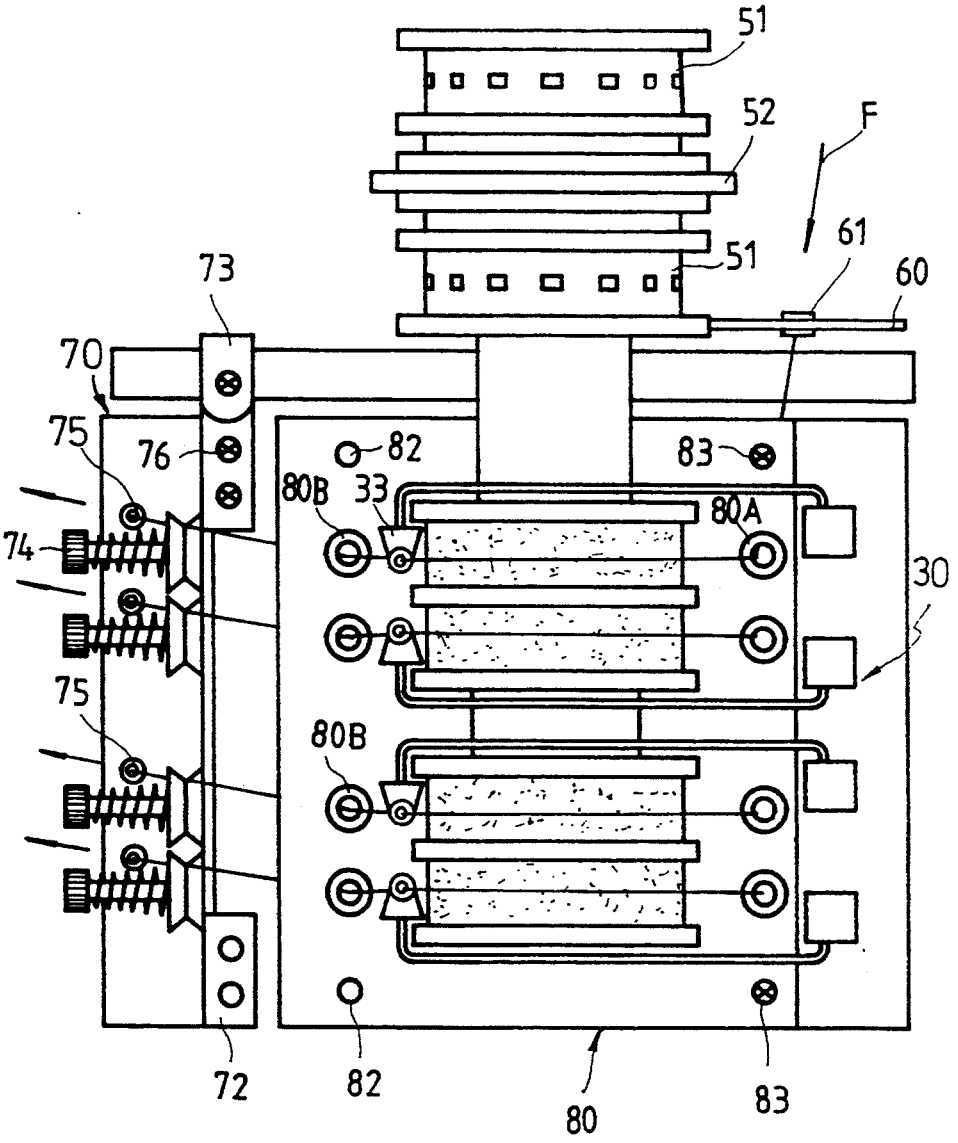
FIG. 3 is a front view according to FIG. 1.
Figure 6:
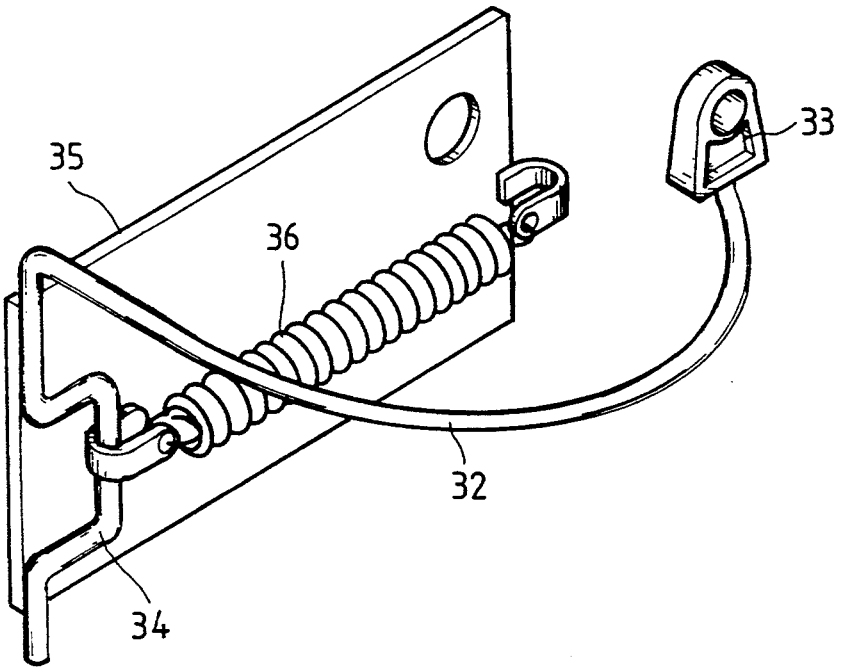
FIG. 6 is a perspective view of the tension control means of the present invention.

As shown in FIGS. 1 and 2, the present invention includes a support body 20 lockable on a beam member 10, multiple tension controlling means 30, a multilayer yarn feeding wheel 40, at least two drive pulleys 50, a clutch 52 disposed between each two pulleys 50, an incoming yarn guiding board 60, a multilayer yarn braking means assembly 70 and a yarn guiding eye means 80. In FIG. 1, the yarn feeding wheel 40 is cut from a main drive shaft 41 for better illustration. The yarn feeding wheel 40 has four drum bodies rotatably concentrically mounted in a bearing 21 of the support body 20. The drive pulley 51 and the clutch 52 are detachably disposed on a top end of the main drive shaft 41. At least two drive pulleys 51 can be driven by drive belts (not shown) at different speeds and the clutch 52 disposed between each two pulleys can be operated to achieve necessary rotary speed of the pulleys 51 for feeding the yarn. In FIG. 3, the multiple tension control means 30 are secured on right side of the yarn guiding eye means 80 by screws 83. As shown in FIG. 6, each tension control means 30 has a movable arch-shaped yarn guiding arm 32 an end of which is disposed with a yarn guiding eyelet 33. The yarn guiding arm 32 is pivotally disposed on an end of a surface of a plate member 35 by a crank 34. One end of a spring 36 is fixed on the crank 34 while the other end of the spring 36 is secured on the other end of the surface of the plate member 35.

Figure 5:
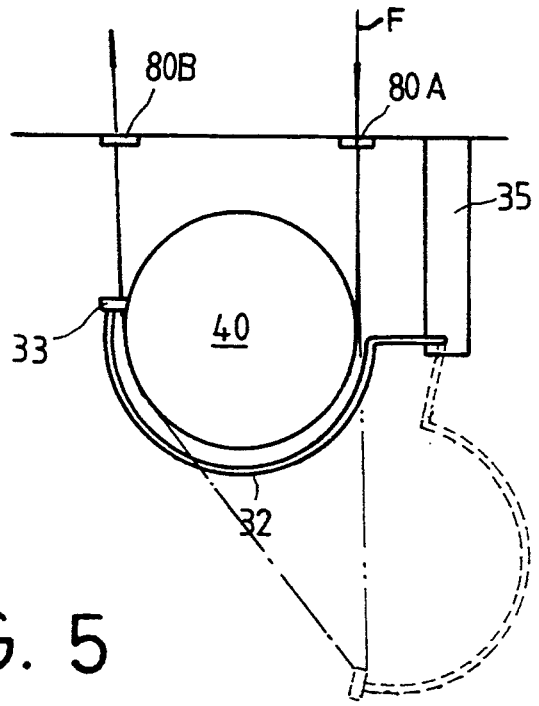
FIG. 5 shows the working state of the movable arch-shaped yarn guiding arm of the present invention.

As shown in FIG. 5, the arch-shaped yarn guiding arm 32 has a diameter larger than that of the yarn feeding wheel 40. When a yarn F is fed, the yarn guiding arm 32 is pivoted from a first position shown by phantom line of FIG. 5 to a second position shown by solid line of FIG. 5. In the second position, the yarn guiding eyelet 33 of the yarn guiding arm 32 reaches a distal outer peripheral portion of the yarn feeding wheel 40, making the yarn F fully contact with the frictional periphery of the yarn feeding wheel 40.. Therefore, the yarn F can be effectively and positively fed. On the other hand, when the yarn F is not fed, the yarn guiding arm 32 is pivoted from the second position to the first position to reduce the frictional contacting area between the yarn F and the periphery of the yarn feeding wheel 40. At this time, the yarn F is prevented from being negatively fed.

Figure 4:
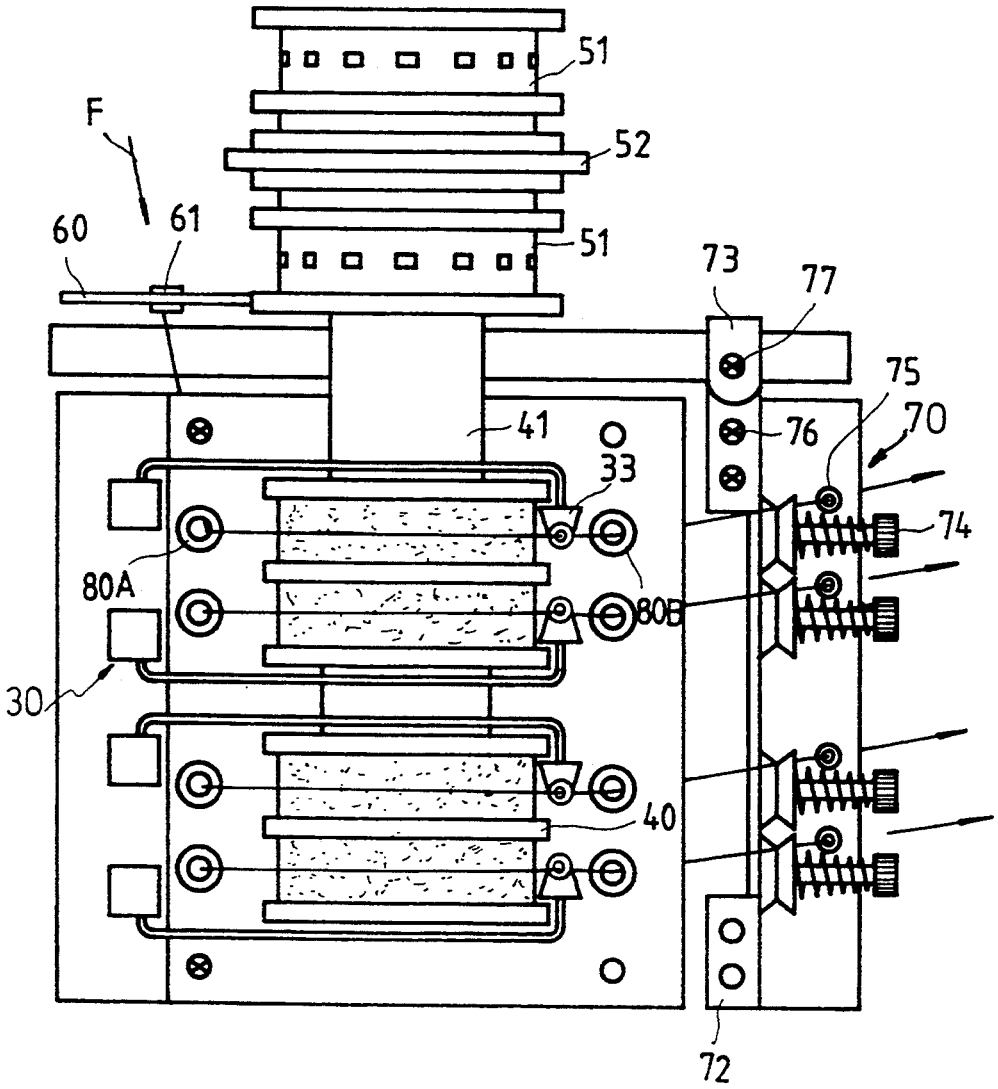
FIG. 4 is a front view of a first embodiment of the present invention.

As shown in FIGS. 1 and 3, the yarn guiding eye means 80 is fixed under the support body 20 at a horizontal section 81. Multiple incoming yarn and outgoing yarn guiding eyes 80A and 808 are disposed on two sides of the yarn guiding eye means 80. Several through holes 82 are disposed on an upper and a low sides of the yarn guiding eye means 80 for screws 83 to pass therethrough to secure the tension control means 30 on the yarn guiding eye means 80. The tension control means 30 can be disposed on the right side of a base board of the yarn guiding eye means 80 or on the-left side thereof as shown in FIG. 4. Naturally, the incoming yarn guiding board 60 can be secured on the support body 20 on the front face or back face thereof in accordance with the position of the tension control means 30. FIG. 3 shows that the incoming yarn guiding board 60 is secured on the front face of the support body 20, while FIG. 4 shows that the guiding board 60 is secured .on the back face thereof. However, the relative position between the guiding board 60 and the tension control means 30 remains unchanged in both cases. The multilayer yarn braking means assembly 70 includes four yarn braking means 74 and four outgoing yarn guiding eyes 75 corresponding to the four drum bodies of the yarn feeding wheel 40. These yarn braking means 74 are fixed on a main surface of a base board 71 while the outgoing yarn guiding eyes 75 are disposed on a perpendicular surface 71A of the base board 71. The base board 71 is provided with upper and low lug fixing sections 72 for screws 76 to pass therethrough to fix to the base board 71 on the beam member 10. Similarly, the yarn braking means 74 and outgoing yarn guiding eyes 75 of the multilayer yarn braking means assembly 70 are disposed with the position thereof changeable according to those of the tension control means 30 and the incoming yarn guiding board 60. Therefore, the location of the present invention can be freely adjusted according to the requirements of factory operation and equipment arrangement so that a most convenient and economic operation can be achieved.

Please refer to FIG. 2 which shows a preferred embodiment of the present invention, wherein for clarifying the yarn traveling path, the yarn feeding wheel 40 is sketched by phantom line while the yarn F is sketched by solid line. The incoming yarn F is guided by a yarn guiding eye 61 of the yarn guiding board 60 into the incoming yarn guiding eye BOA. The yarn F is further guided by the movable arch-shaped yarn guiding arm 32 to substantially surround the periphery of the yarn feeding wheel 40. The yarn F then goes through the yarn guiding eyelet 33 of the yarn guiding arm 32 to be guided by the outgoing yarn guiding eye 80B toward the yarn braking means 74. The yarn F is finally guided by the outgoing yarn guiding eye 75 onto a knitting maching. It can be seen from FIGS. 2 and 5 that during the positive yarn feeding operation, the contacting angle between the yarn F and the periphery of the yarn feeding wheel 40 is larger than 180 degrees and by means of the yarn braking means 74, once the knitting machine no more needs the yarn F, the outgoing yarn F remains properly tensioned with the yarn guiding arm 32 pivoted outward as shown in FIG. 5, so that an upward and a downward yarns will not twist with each other due to external force such as a blowing force of a fluff blowing fan.

It can be known from the above that the yarn feeding wheel of the present invention includes four drum bodies which feed four different yarns simultaneously. Two upper drum bodies of the yarn feeding wheel 40 can feed yarns with one color, while two lower drum bodies of the yarn feeding wheel 40 can feed yarns with another color. In contrast to the above arrangement of this invention, in the conventional positive yarn feeding operation, four separate yarn feeding wheels respectively driven by different belts are required. Obviously, in the later case, much more space is needed for installation of the individual wheels.

Figure 7:
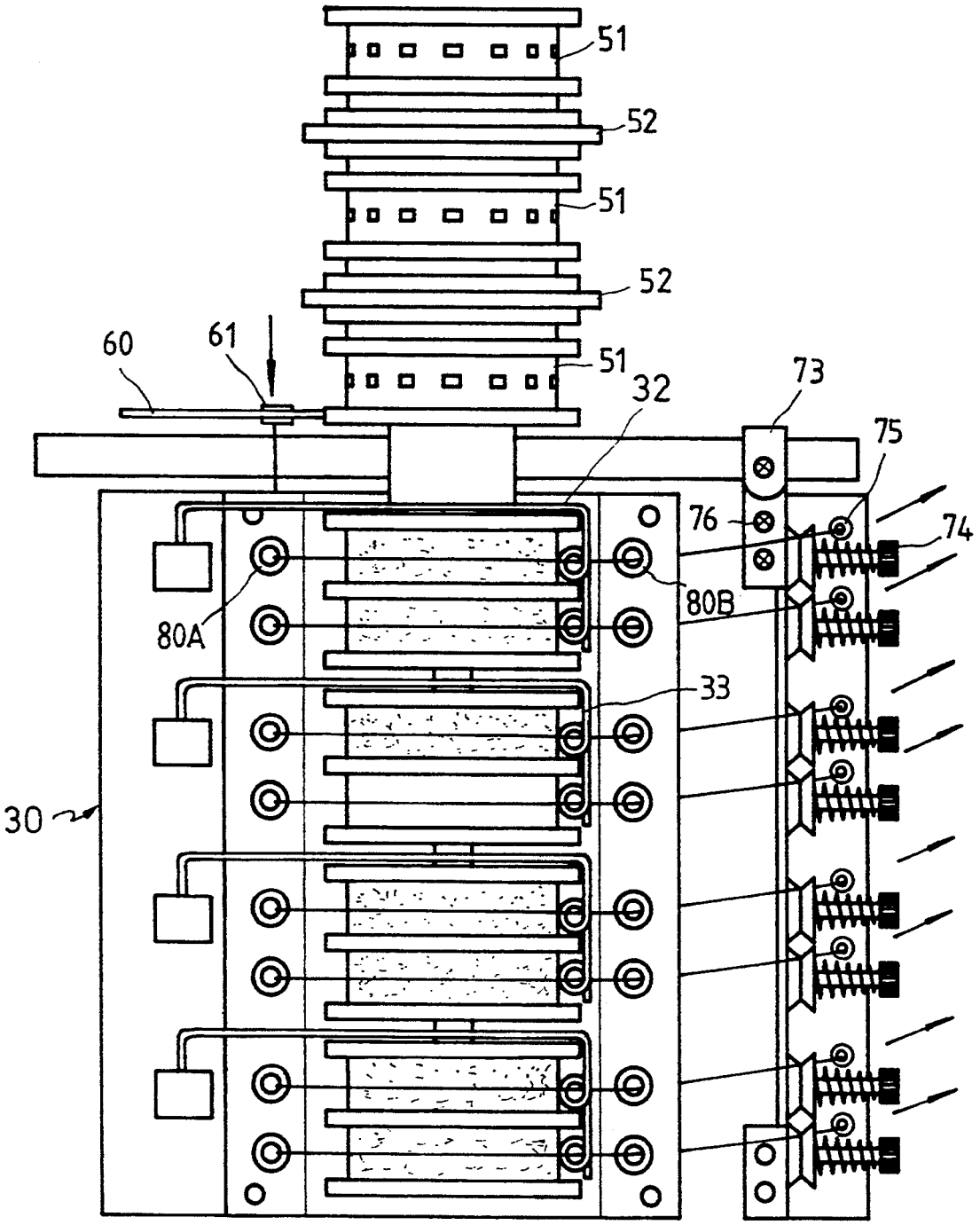
FIG. 7 is a front view of a second embodiment of the present invention.
Figure 8:
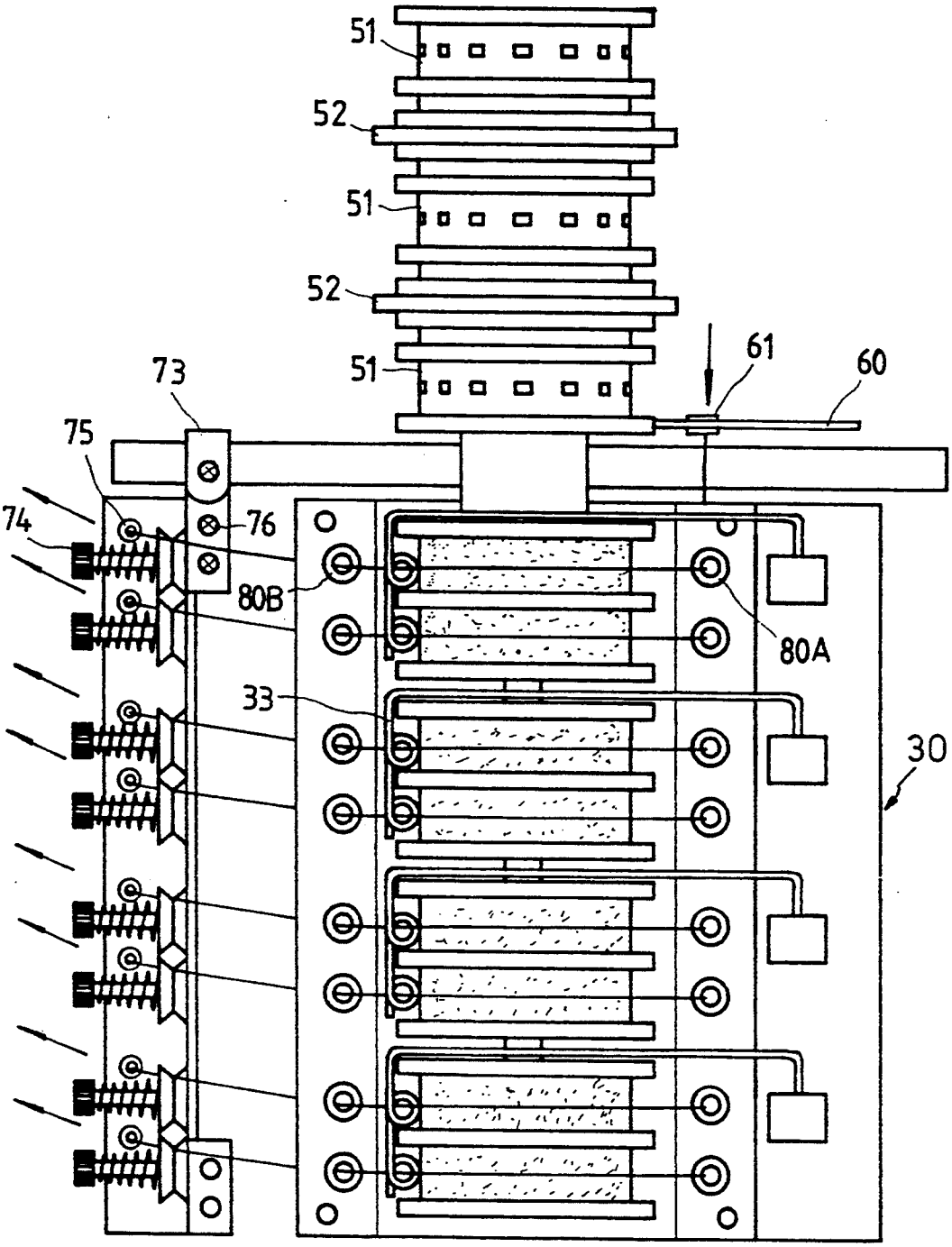
FIG. 8 is a front view of a third embodiment thereof.
Figure 9:
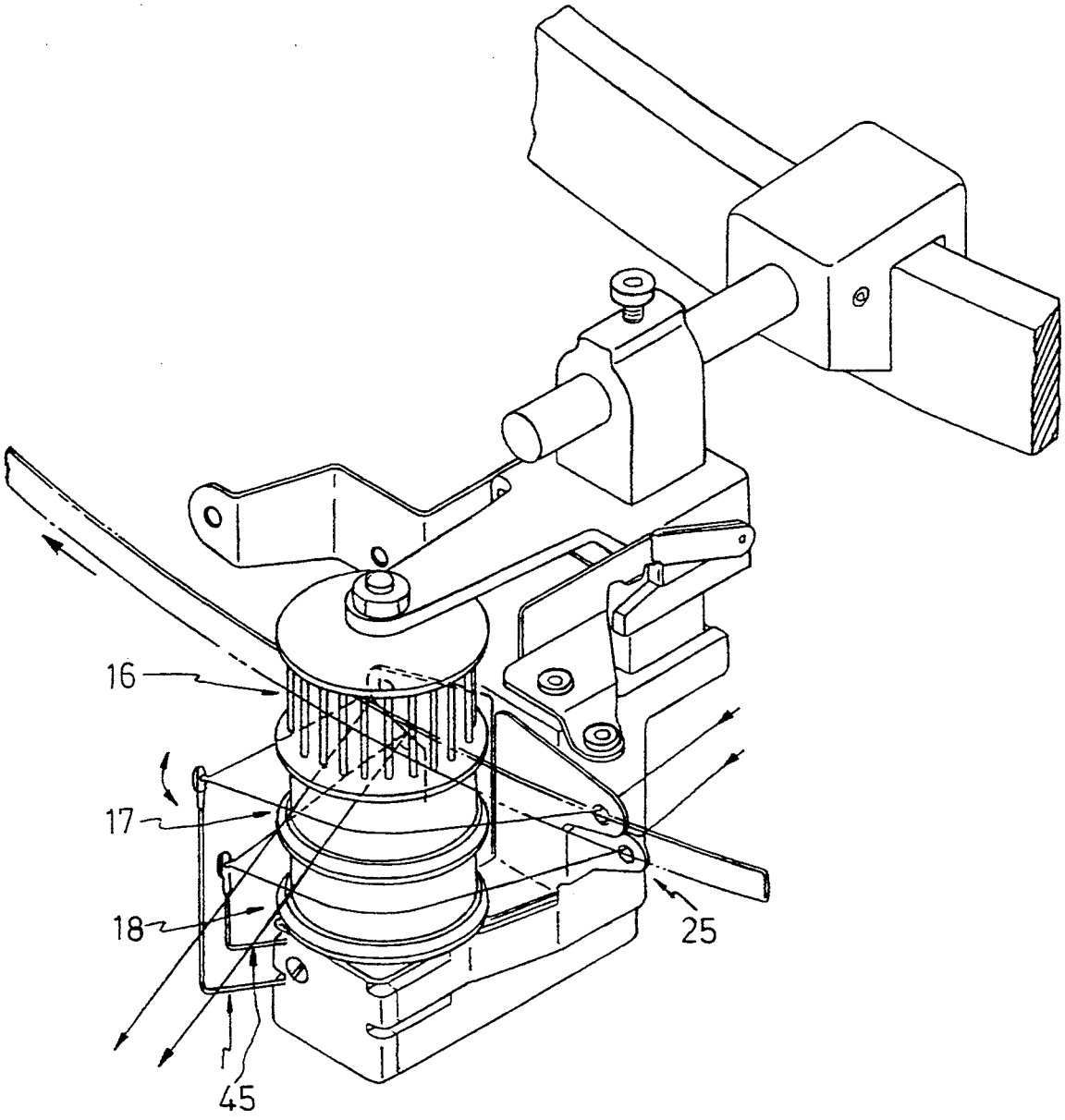
FIG. 9 (PRIOR ART)
FIG. 9 is a perspective view of the conventional positive yarn feeding device.
Figure 10:
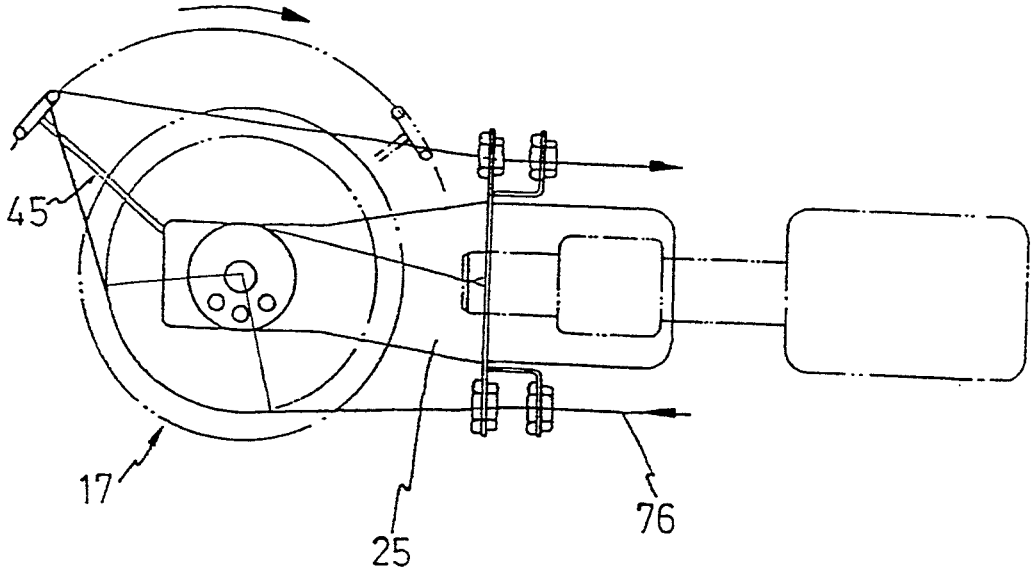
FIG. 10 (PRIOR ART)
FIG. 10 is a plan view showing the yarn feeding wheel of FIG. 9 in a non-yarn feeding state.
Figure 11:
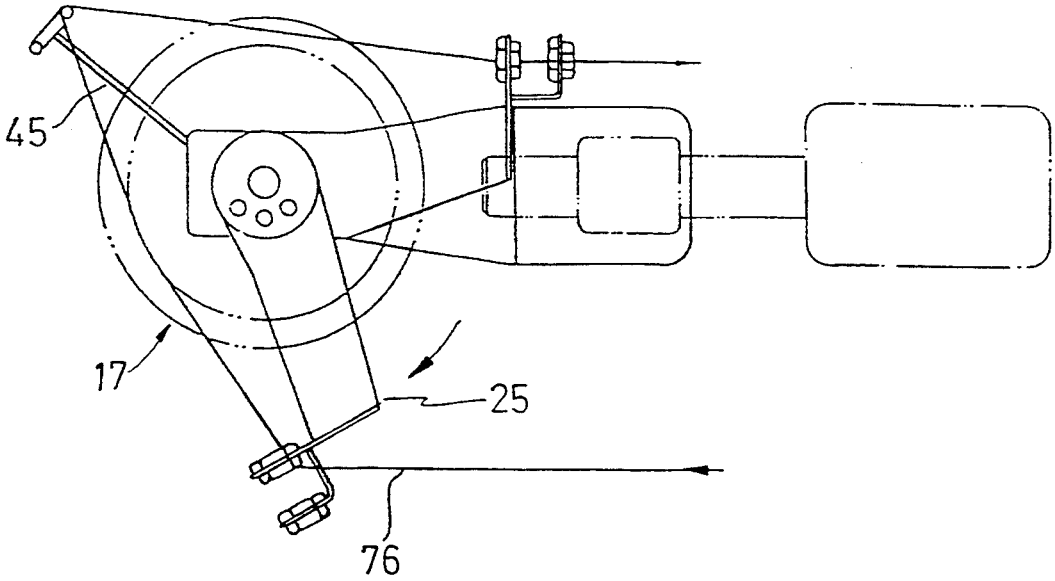
FIG. 11 (PRIOR ART)
FIG. 11 is a plan view according to FIG. 10, wherein the contacting angle between the yarn and the peripherey of the yarn feeding roller is minimized.

In another preferred embodiment of the present invention as shown in FIGS. 7 and 8, a wheel with eight drum bodies is used to feed eight yarns simultaneously. Accordingly, four different colors of yarns can be fed simultaneously. In this embodiment, the tension control means 30 has two yarn guiding eyelets 33 disposed at an end of the yarn guiding arm 32. Correspondingly, the number of the-yarn braking means 74 is doubled to cooperate with the yarn guiding eyelets 33. Moreover, the number of clutches 52 can be increased to achieve multiple stages of operating speed. In conclusion, the present invention eliminates the shortcomings existing in conventional positive yarn feeding device by moving the tension control means from a lower position to a left or a right side of the yarn feeding wheel. Moreover, a yarn braking means for controlling the tension of the yarn is disposed on the yarn outgoing side so as to prevent the multiple yarns from twisting with one another due to the interference from an external force. In addition, the tension control means 30, incoming yarn guiding board 60 and multilayer yarn braking means assembly 70 of the present invention can be freely disposed on eigher side according to the factory requirement. This will save working time, increasing the product amount and improve the product quality. Especially, the space for disposing the yarn feeding wheel is greatly reduced. This is convenient for operations of yarn passing, yarn processing, yarn adjustment or yarn replacement.

The above embodiments are only examples of the present invention and the scope thereof is not limited by these examples. Therefore, the present invention should include all the measures that employ multiple yarn feeding wheels which are freely rotatably concentrically disposed, multiple drive pulleys and clutches which optionally provide necessary operation speed and include all the measures that employ yarn tension control means, yarn pressing means and corresponding yarn incoming and outgoing guiding eyes which are disposed respectively on two lateral sides of the yarn feeding wheel.

I claim:

1. A positive yarn feeding device comprising:

a support body mounted on a beam member, multiple yarn feeding drum bodies included in a yarn feeding wheel rotatably mounted on said support body, each yarn feeding drum including a frictional contact surface so as to increase friction between the drum body and the yarn, multiple drive pulleys with a clutch being disposed between each two drive pulleys, the drive pulleys being rotatably mounted on said support body;

the device being characterized in that each yarn feeding drum body feeds yarn in a yarn path including an incoming yarn guiding eyelet, a tension control means including a movable yarn guiding arm, and an outgoing yarn guiding eyelet, and wherein a yarn braking assembly is disposed on a side of said yarn feeding wheel corresponding to an outgoing yarn path, the braking assembly including multiple yarn braking means, the number of braking means corresponding to the number of feeding drum bodies, whereby tension is maintained on the yarn even when no pulling force is applied from a knitting machine.

2. The yarn feeding device as claimed in claim 1 wherein:

a horizontal yarn guiding board is disposed in the yarn path at a position such that the yarn passes through the guiding board before passing over said yarn feeding wheel, said yarn guiding board including a multiplicity of incoming yarn guiding eyelets.

3. The yarn feeding device as claimed in claim 1 wherein:

said movable yarn guiding arms are arched and have a diameter larger than that of said yarn feeding wheel.

4. The yarn feeding device as claimed in claim 2 wherein:

the positions of said movable yarn guiding arms and said yarn braking means in said yarn path may be changed as a function of the position of the tension control means and the yarn guiding board, so that the device may be adapted to the requirements of a given yarn processing environment.

5. The yarn feeding device as claimed in claim 1 wherein:

at least one additional yarn guiding eyelet is disposed at a free end of said movable yarn guiding arm, said movable yarn guiding arm being pivotably mounted so as to pivot back and forth between a first position in which said yarn guiding eyelet is removed from said frictional contact surface of said yarn feeding drum bodies and a second position in which said yarn guiding eyelet is adjacent to the frictional contact surface of said yarn feeding drum bodies.

6. The yarn feeding device as claimed in claim 1 wherein:

said movable yarn guiding arm includes two or more additional yarn guiding eyelets attached thereto.

* * * * *